US005170717A

United States Patent [19]

Richmond et al.

[11] Patent Number: 5,170,717

[45] Date of Patent: Dec. 15, 1992

[54] RAILROAD CARS FOR TRANSPORTING CYLINDRICAL OBJECTS TRANSVERSELY WITH MULTI-PIECE MOVABLE COVER FOR EXPOSING ENTIRE CARGO AREA

[75] Inventors: Shaun Richmond, Orland Park, Ill.; Richard D. Curtis, Munster, Ind.

[73] Assignee: Thrall Car Manufacturing Company, Chicago Heights, Ill.

[21] Appl. No.: 758,164

[22] Filed: Sep. 11, 1991

Related U.S. Application Data

[63] Continuation of Ser. No. 496,550, Mar. 20, 1990, abandoned.

[51] Int. Cl.[5] ..... B61D 39/00

[52] U.S. Cl. ..... 105/377; 410/49; 105/418

[58] Field of Search ..... 105/355, 362, 377, 378, 105/413, 416, 418; 410/36, 42, 47, 49, 68

[56] References Cited

U.S. PATENT DOCUMENTS

| | | | |
|---|---|---|---|
| 1,099,361 | 6/1914 | Hartland | 105/377 |
| 1,850,597 | 3/1932 | McGuire | 410/48 |
| 2,494,404 | 1/1950 | Nixon | 296/28 |
| 2,810,602 | 10/1957 | Abrams | 410/42 |
| 2,977,900 | 4/1961 | Farrar | 410/47 |
| 3,233,561 | 10/1966 | Yelin | 105/377 X |
| 3,291,072 | 12/1966 | Cunningham | 105/367 |
| 3,291,073 | 12/1966 | James | 195/367 |
| 3,392,682 | 7/1968 | Francis | 410/42 |
| 3,520,257 | 7/1970 | James | 105/377 |
| 3,540,771 | 11/1970 | Stoneburner | 105/377 |
| 3,715,993 | 2/1973 | Orlik | 105/36.7 |
| 3,815,518 | 6/1974 | Schneider et al. | 105/378 |
| 3,818,843 | 11/1972 | Lee | 410/68 |
| 3,828,693 | 8/1974 | Kampmann et al. | 105/378 |
| 3,994,240 | 11/1976 | Berg et al. | 105/377 |
| 3,999,489 | 12/1976 | Kramer et al. | 105/378 |
| 4,274,776 | 6/1981 | Paton et al. | 410/57 |
| 4,341,163 | 7/1982 | Ritzl | 105/377 |
| 4,569,293 | 2/1986 | Kramer et al. | 105/377 |
| 4,751,882 | 6/1988 | Wheatley et al. | 410/65 X |
| 4,841,876 | 6/1989 | Gramse et al. | 105/406 |

FOREIGN PATENT DOCUMENTS

| | | | |
|---|---|---|---|
| 2052416 | 1/1981 | United Kingdom | 410/49 |

OTHER PUBLICATIONS

MacGregor Brochures, Railroad Supply and Equipment Inc., Pennsylvania, Oct. 15, 1963.

*Primary Examiner*—Robert J. Oberleitner
*Assistant Examiner*—S. Joseph Morano
*Attorney, Agent, or Firm*—Fitch, Even, Tabin & Flannery

[57] ABSTRACT

Railroad car for transporting transversely oriented cylindrical objects. The cargo bed of the car projects downwardly through the draft sills, interrupting the draft sills. The car has one or more troughs defined by pairs of facing cylindrical object support members. The support members at the front and rear of the car also transmit loads from the draft sills downwardly to lower longitudinal members which bridge between the respective draft sills. Also, a telescoping cover for a railroad car which covers the entire cargo bed during transport, and uncovers the entire cargo area at once without removing the covers from the car. Thus the entire car can be loaded or unloaded without shifting the covers. The front sections and rear sections of the cover telescope independently to the front and rear of the car, thus allowing the entire cover to be positioned outboard of the cargo bed when open while remaining on track means associated with the car. Removable one-piece and two-piece covers are also disclosed.

20 Claims, 6 Drawing Sheets

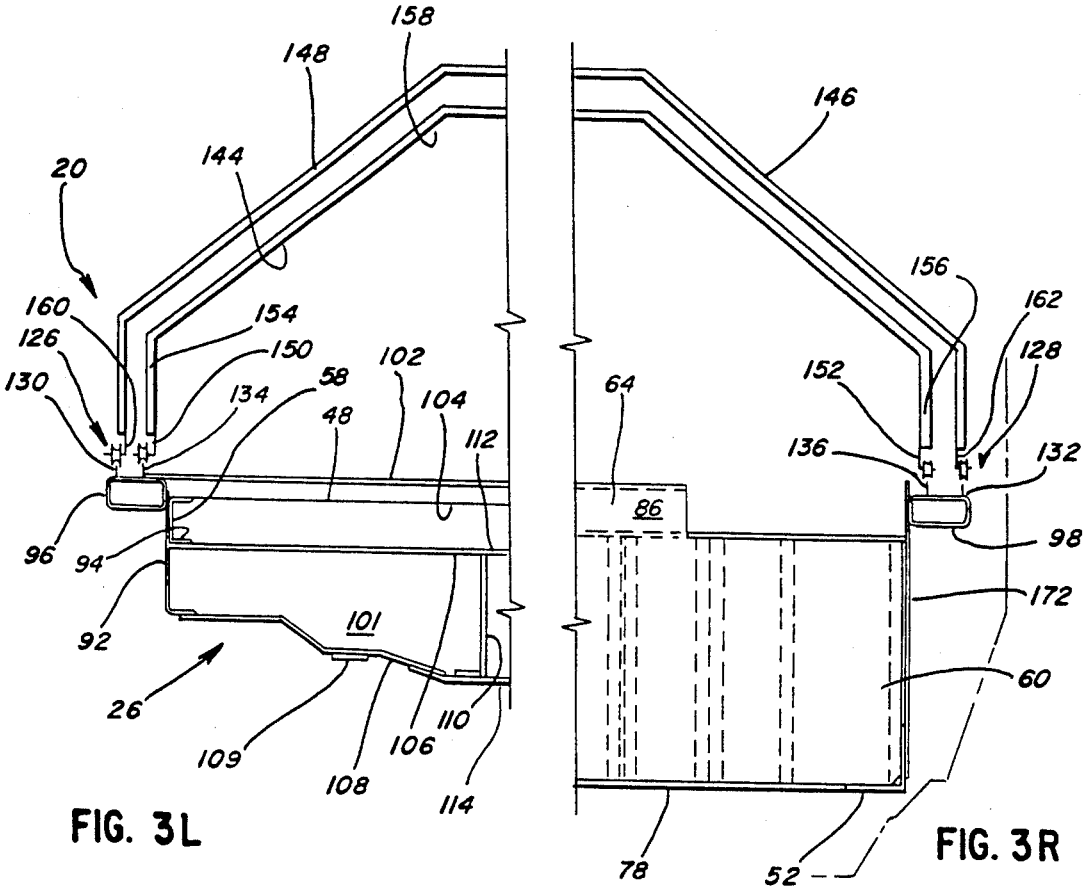
FIG. 3L
FIG. 3R
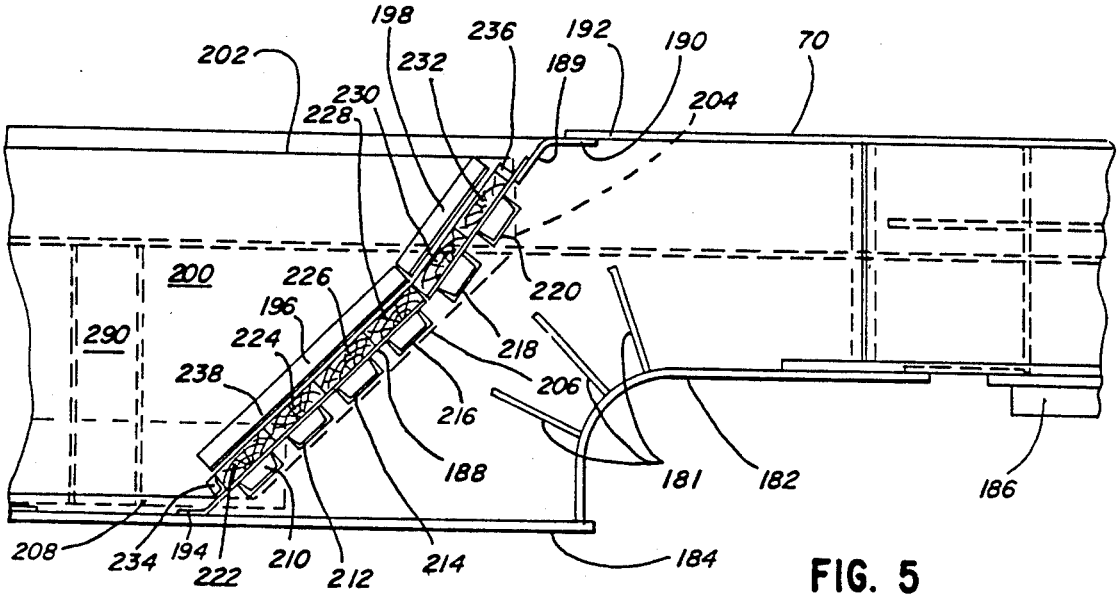
FIG. 5

RAILROAD CARS FOR TRANSPORTING CYLINDRICAL OBJECTS TRANSVERSELY WITH MULTI-PIECE MOVABLE COVER FOR EXPOSING ENTIRE CARGO AREA

This application is a continuation of application Ser. No. 07/496,550, filed Mar. 20, 1990 now abandoned.

BACKGROUND OF THE INVENTION

The present invention relates to a railroad car for transporting at least one cylindrical object with its axis transverse to the direction of travel of the car. The present invention also relates to a telescoping cover assembly for a railroad car. The cover is movable between a first position on the car covering the entire cargo bed and a second position on the car uncovering the entire cargo bed at once.

Large, heavy cylindrical objects, and particularly coils of rolled steel, are commonly transported on a flatcar or a troughed car. Either type of car has a cargo bed supported on a center sill or similar structure running the length of the car. The individual coils are chained or otherwise restrained in place. In some cars of this type, the coils are carried with their axes longitudinal with respect to the direction of travel of the car. Examples of this arrangement are U.S. Pat. Nos. 2,494,404, issued to Nixon on Jan. 10, 1950 (which shows a semi-trailer, instead of a railroad car) and 3,291,072, issued to Cunningham on Dec. 13, 1983. In other instances, the coils are carried with their axes transverse to the direction of travel of the car. Examples of this construction are U.S. Pat. Nos. 3,291,073, issued to James on Dec. 13, 1966; 1,850,597, issued to McGuire on Mar. 22, 1932; and 3,715,993, issued to Orlik on Feb. 13, 1973 (in which the cylindrical objects are cable reels).

When the coils are carried with their axes longitudinal to the direction of the car, the coils can move longitudinally in the bed due to acceleration, deceleration, or yard impacts. The interior turns of the coils can also extend or telescope axially out of the coils responsive to the same forces. (In relation to steel coils, "telescope" here means that the inner coils extend out of line with the outer coils. Respecting the sections of a cover, "telescope" means that the covers are shifted to an overlapping relation.) To alleviate these types of longitudinal movement, the prior art has placed transverse bars forward and aft of each coil. However, the weight of a steel coil is so great that the coil or its inner turns may shift longitudinally against the transverse bar. The steel is soft enough that the bar can be impressed on the exposed edges of the coil and even embedded in the coil, preventing the coil from being lifted vertically out of the car. Such engagement of the steel coil with the transverse bar damages or even ruins the metal of the coil. This problem is discussed in the James '073 patent cited above.

Cylindrical objects such as steel coils have also been carried transversely in troughs. Each trough has facing, inwardly inclined surfaces which support the coil. The transverse orientation of the coil prevents the inner turns from telescoping and centers the coil on the trough, preventing both forms of shifting. A disadvantage of such troughs is that some or all of the troughs and coils are supported above the center sill or similar structure for handling draft and buff loads. A flatcar does not allow the coils or troughs to project below the center sill of the car.

An example of a European coil steel car, which supports one of several coils very slightly lower than the tops of the side sills of the car, is shown on page 41 of the DB Guterwagen brochure. That brochure does not illustrate a center sill. The side sills are massive and accept the buff loads directly through the buffers at each end of the car. Since the date of the brochure and the extent and manner of its distribution are not fully known, it is not admitted to be prior art.

At least two disadvantages result from supporting the cylindrical objects high on the car. One disadvantage is that the center of gravity of a loaded car is substantially above the coupler level. A car loaded high is more subject to rocking and rolling, and when the car collides with another car in a switching yard the opposite end of the car tends to pitch upward. This jostles the coils vertically, which may damage either the coils or their supports. Another disadvantage is that the covers provided for the car to protect the steel coils from the weather must be taller than the largest coils to be transported by the car, enclosing a large volume of air around the coils. The large size of the covers makes them quite heavy. The large enclosed volume beneath the covers, including the volume enclosed from below by the cargo bed, increases the amount of atmospheric moisture available to condense on the coils, thus increasing the amount of rust formed on the coils.

Another problem in the art is that the troughs contribute little support to the structure of the car. The car must have independent means to accept the draft and buff loads of a railroad train, as well as transverse and vertical structure to stiffen the car. This problem is particularly acute when the troughs are defined by pallets which are removable from the car with the coils.

Well cars which have no center sill, and which transmit longitudinal loads from the couplers and draft sills through side sills, top chords, and other longitudinal members beside or beneath the cargo bed, are known. One example of such well car construction is U.S. Pat. No. 4,841,876, issued to Gramse et al. on Jun. 27, 1989 FIGS. 2–6, 9, and the corresponding parts of the specification of that patent are hereby incorporated herein by reference to show the transfer of longitudinal loads downwardly from the coupler level to the shear plates 60 and side sills (such as 38 in FIG. 9) of the car. We believe the well car plan of construction has not previously been used in a car dedicated to the transport of heavy cylindrical objects.

Another problem in the art has been how to cover a load on the cargo bed of a railroad car. In Europe, railroad cars are known which have a longitudinally telescoping cover. The cover is made in segments which travel on longitudinal rails on either side of the cargo bed. The segments may be extended to cover the entire load at once. Examples of this construction are U.S. Pat. Nos. 4,569,293, issued to Kramer et al. on Feb. 11, 1986; and 4,341,163, issued to Ritzi on Jul. 27, 1982. Telescoping doors having some features in common with sliding covers are disclosed in U.S. Pat. Nos. 3,815,518, issued to Schreider et al. on Jun. 11, 1974; 3,828,693, issued to Kampmann, et al. on Aug. 13, 1974; and 3,999,489, issued to Kramer et al. on Dec. 28, 1976. Typically, the cover mates with fixed bulkheads on each end of the car to complete a cover which is relatively weatherproof.

However, in known cars with telescoping covers, even if the cover is fully telescoped for unloading the car, at least part of the cargo bed is still obstructed by the cover. Thus, the cover must be fully telescoped at one end of the car, following which the opposite end of the car is unloaded, the telescoped cover assembly is moved on its rails to the unloaded portion of the car, and the remaining portion of the car is unloaded. Thus, many operations must be performed in sequence to unload the car. It would be simpler to uncover the car entirely in a single step, then unload it in a single step.

The prior art has been able to follow this simpler procedure only when the covers are removable from the car, in which case they must be lifted off with a crane and stored somewhere before the car is unloaded. Removable covers are disclosed in U.S. Pat. No. 3,994,240, issued to Berg et al. on Nov. 30, 1976.

Thus, one has had to choose between 1) covers which must be removed to expose the complete cargo bed, and 2) telescoping cover assemblies which cannot uncover the entire bed at once for unloading.

OBJECTS OF THE INVENTION

A general object of the invention is to overcome one or more of the deficiencies of the prior art described above.

Another object of the present invention is to provide a railroad car for transporting cylindrical objects in a transverse orientation so that at least a portion of each object projects below a horizontal plane defined by the draft sills of the car.

An additional object of this invention is to provide a well car for carrying cylindrical objects in which at least part of the longitudinal loads through the car are borne by at least one lower longitudinal member extending below the level of the draft sills, and in which longitudinal loads are transferred between the draft sills and the lower longitudinal member by elements of integral troughs for the cylindrical objects. Thus, at least two of the trough elements perform the dual functions of supporting cylindrical objects and transmitting loads through the car.

Still another object of the invention is to provide a car of the construction previously described which has covers for protecting the cylindrical objects from the environment during transport. Preferably, the covers are shorter than the diameter of the largest roll or cylindrical object they are intended to cover and weigh as little as possible.

Yet another object of the invention is a telescoping cover for a railroad car which can entirely cover the cargo bed during transport, and which can entirely uncover the cargo bed in one position when the car is to be unloaded.

Still another object of the invention is a telescoping cover which has integral bulkheads, replacing the fixed bulkheads at either end of a conventional car.

Another object of the invention is a coil steel car which has a cargo bed and covers which enclose the minimum possible volume of air.

Other objects of the invention, and the means provided for satisfying one or more objects, will be apparent upon consideration of this specification and the accompanying drawings and claims.

SUMMARY OF THE INVENTION

One aspect of the invention is a railroad car for transporting cylindrical objects with their axes transverse to the direction of travel of the car. The car comprises wheel trucks, a body supported on the wheel trucks, and integral cylindrical object troughs as part of the body. The body includes front and rear stub draft sills having upper extremities defining a first horizontal plane. The body also includes at least one lower longitudinal member below the first horizontal plane. The body may also have top chords which accept part of the longitudinal draft and buff loads and support a cover which is shorter than the diameter of the largest object to be carried. At least two of the walls of the troughs transmit longitudinal and vertical forces from the draft sills of the car downwardly and outwardly to the lower longitudinal member and the side chords and side sheets, thereby simultaneously directing some of the loads on the car around or below the cargo bed and supporting the cylindrical objects. By providing double-duty structure, weight savings can be realized. The troughs also eliminate the need for a separate floor sheet and minimize the amount of enclosed air beside and below each coil.

Another aspect of the invention is a telescoping cover of the type movable on longitudinal tracks running beside the cargo bed of a railroad car. The cover includes front and rear cover segments which can be moved outboard on the tracks sufficiently to completely uncover the cargo bed. The cover may also include at least one center segment between the front and rear segments of the cover which telescopes with at least one of the front and rear segments in their outboard positions, again uncovering substantially the entire cargo bed of the car when all the cover segments are in their outboard positions. Complete exposure of the cargo bed is accomplished by shifting cover segments to both ends of the car at once, extending the longitudinal tracks substantially beyond the cargo bed, or cantilevering the outboard ends of the covers so they extend outboard of the ends of the car when the covers are opened to expose the cargo bed.

BRIEF DESCRIPTION OF DRAWINGS

FIG. 3 is a composite transverse section of FIG. 2, the left section being a half section taken along line 3L—3L of FIG. 2, the right section being a half section taken along line 3R—3R of FIG. 2.

FIG. 5 is an enlarged, fragmentary longitudinal section of FIG. 4, showing the details of one wall of one trough and the associated draft sill shear plates, side sills, and top chords of the car.

DETAILED DESCRIPTION OF THE INVENTION

While the invention will be described in connection with certain preferred embodiments, it will be understood that we do not intend to limit the invention to those embodiments. On the contrary, we intend to protect all alternatives, modifications, and equivalents as may be included within the spirit and scope of the invention as defined by the appended claims.

Figure 1:
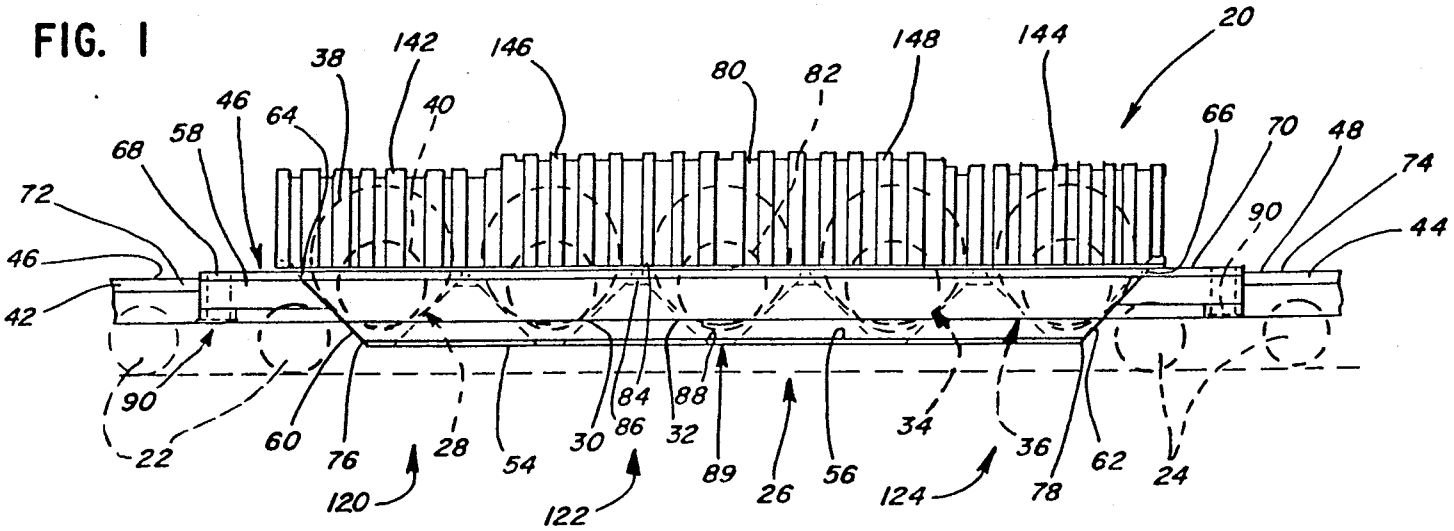
FIG. 1 is a schematic side elevation of a railroad car according to the present invention with the wheel trucks and couplers removed. The wheels, loaded steel coils, and troughs are shown in phantom, and the telescoping cover is closed.

Referring first to FIGS. 1 and 3, the railroad car 20 generally comprises front and rear wheel trucks (not shown) defined by wheels 22 and 24, a body generally indicated at 26, and integral troughs generally indicated at 28, 30, 32, 34, and 36 for supporting cylindrical objects such as the large coil of steel 38 or the small coil of steel 40 on the trough 28. The "front" and "rear" wheel trucks 22 and 24 and other "front" and "rear" parts of the car 20 are so defined for convenience only. This can be a reversible car, adapted to be transported in either direction.

The body 26 comprises a front stub draft sill 42 and a rear stub draft sill 44. The draft sills 42 and 44 respectively have upper extremities 46 and 48 which define a horizontal plane. This horizontal plane is sometimes known herein as a first horizontal plane, to distinguish it from a second horizontal plane described later. (Alternatively, the first horizontal plane might be defined at the tops of the wheels 22 and 24, at the center lines of the same wheels, or at the bottoms of the draft sills or top chords). As FIG. 1 illustrates, the troughs 28–36 and the coils such as 38 or 40 each project downwardly through the first horizontal plane. A lower longitudinal member generally indicated at 54 is disposed in a second horizontal plane below the first horizontal plane. A cargo bed 56 is provided in which the troughs 28–36 and at least the lower parts of the coils such as 38 or 40 are disposed.

One part of the longitudinal loads in the car is distributed between the draft sills 42 and 44 by the top chords 58 which extend the length of the car on either side of the cargo bed 56. Another part of the longitudinal loads transmitted between the draft sills 42 and 44 is carried through at least one lower longitudinal member, here the side sills 52 and 54 and the shear plate (not shown) or other structure generally coplanar with and joining the side sills 52 and 54. A significant proportion of these loads are transmitted to and from the draft sills 42 and 44 by the walls 60 and 62 of the troughs 28 and 36. The walls of all the troughs and associated structure are also known herein as front and rear cylindrical object support members.

The walls 60 and 62 have upper or outboard edges 64 and 66 which are connected to the upper shear plates 68 and 70 joined to the upper horizontal webs 72 and 74 of the draft sills 42 and 44. Webs 60 and 62 also have lower or inboard ends 76 and 78 which connect, via a lower shear plate or other construction (not shown), to the side sills such as 52 and 54. Because the webs 60 and 62 are inclined toward the center of the car about transverse axes, they transmit a substantial portion of the longitudinal loads on the draft sills 42 and 44 to the side sills 52 and 54.

The interior troughs, such as the trough 32 for carrying coils such as 80 or 82, have upper ends such as 84 connected to transverse bridges 86 between the top chords such as 58. The troughs such as 32 similarly have lower edges 88 extending beneath and secured to transverse bridges 89 between the side sills 52 and 54. The transverse bridges and troughs define an undulating, continuous bottom of the car, which protects the lading from below and reduces the volume of enclosed air adjacent to the lading.

All the interior trough walls obliquely extend from the top chords such as 58 (via the bridges 86) to the side sills 52 and 54 (also via transverse bridges), and thus are capable of transmitting longitudinal loads between the top chords such as 58 and the side sills 52 and 54. We contemplate that the walls 60 and 62 will bear more longitudinal loads than the interior coil supports, however, due to the proximity of the walls 60 and 62 to the draft sills 42 and 44. We contemplate that the walls 60 and 62 will distribute nearly all the vertical loads at the ends of the car. The remaining trough walls will primarily distribute vertical, longitudinal, transverse, and other loads caused by the large inertia of the coils resisting rocking, acceleration and deceleration of the car 20.

The left side of FIG. 3 shows a transverse section of the bolster area 90 of the car 22 where it rests on a wheel truck (not shown). The composite side structure of the car is defined by a generally L-shaped web 92, a generally U-shaped web 94, and top chords 96 and 98. The top chords 96 and 98 are the support for the cover rails described below. The bolster area 90 comprises a bolster web 101, a top cover plate 102, an end deck plate 104, a shear plate 106, a bottom cover plate 108, a side bearing wear plate 109, and a draft sill defined by vertical webs such as 110, an upper web 112 extended from the shear plate 106, and a lower web 114 secured to or extending from the cover plate 108.

Figure 2:
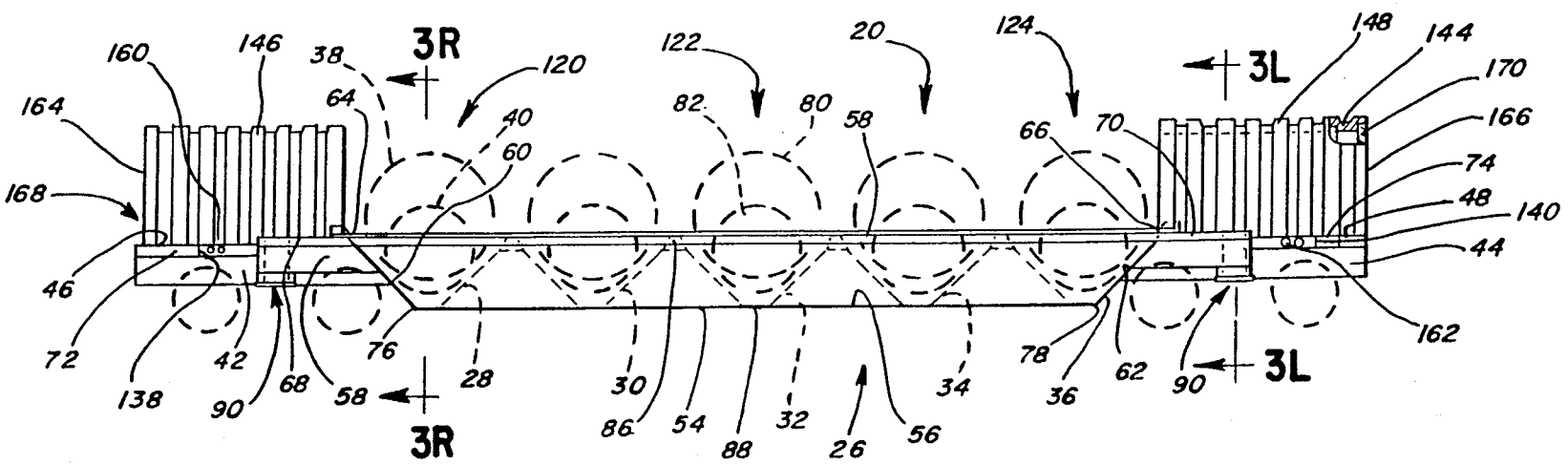
FIG. 2 is a view similar to FIG. 1, showing the telescoping cover fully open and one corner of one center cover segment cut away to reveal the telescoped end cover segment.

FIGS. 1–3 also show a telescoping cover according to the present invention. FIG. 1 shows the cover fully closed. FIG. 2 shows the cover fully open, exposing the entire cargo bed so each of the troughs 28–36 can be loaded or unloaded at once.

The parts of the car cooperating with the cover assembly are left and right transversely spaced edges defined by the top chords 96 and 98 and a front portion 120, a center portion 122, and a rear portion 124 of the cargo bed 56.

The cover is carried on left and right longitudinal track means generally indicated as 126 and 128, here specifically comprising outer tracks 130 and 132 and inner tracks 134 and 136. The outer tracks 130 and 132 extend essentially the entire length of the car, and have outboard extremities generally indicated at 138 and 140 in FIG. 2. The inner tracks 134 and 136 can have the same outboard extremities as the outer tracks, but can be interrupted in the middle of the car.

The cover comprises a front cover segment 142, a rear cover segment 144, and in this embodiment also includes two center cover segments 146 and 148.

The cover segments 142 and 144 each have wheel trucks such as 150 and 152 at their respective edges 154 and 156. Those edges are joined by a continuous upper wall 158 bridging the cargo bed 56 between the track means 126 and 128. The front and rear cover segments 142 and 144 are movable along the tracks 134 and 136 between inboard positions shown in FIG. 1 for covering the front and rear portions 120 and 124 of the cargo bed 56 and outboard positions shown in FIG. 2 for exposing the front and rear portions 120 and 124 of the cargo bed 56.

The center cover segments 146 and 148 are configured and operate in exactly the same manner as the front and rear cover segments, except that they run on the outer tracks 130 and 132 and they are larger than the segments 142 and 144, so the front and rear cover segments 142 and 144 can be fully telescoped with the center cover segments 146 and 148. The smaller cover segments could be the center cover segments and the larger cover segments could be the front and rear cover segments without departing from the scope of the invention.

One feature of the present cover distinguishing it from prior covers is that it is withdrawn in two sections, one at the front of the car and the other at the rear of the car. As a result, the sections are short enough longitudinally to uncover the entire cargo bed 56 without extending beyond the ends of the car. To facilitate this result, the outboard extremities 138 and 140 of the track means 126 and 128 can be extended further outboard, or, as illustrated in FIG. 2, the most outboard wheel trucks such as 160 and 162 of the covers can be disposed inboard of the outer edges 164 and 166 of the covers 146 and 148. By cantilevering the ends 164 and 166 outboard of the most outboard wheel trucks 160 and 162, the covers 146 and 148 can be allowed to extend over the coupling of the car if that is necessary to allow the cover to be opened sufficiently to expose the entire cargo bed 56 for unloading.

Another feature of the invention is the elimination of fixed bulkheads at either end of the car to mate with the covers. Outer walls 168 and 170 at the edges 164 and 166 of the covers substantially close the area bounded by the outer edges 164 and 166 of the respective cover segments. The center covers 146 and 148 do not have end walls so they may clear the cargo bed 56 and the load therein. (A small bulkhead may be provided which mates with a corresponding cut-out at the base of the outer wall 168 of the cover to allow the end 164 to clear brake equipment located on the end deck plate 104 of the car.)

Although FIGS. 1–3 do not show this, the wheel trucks 150, 152, 160, 162, etc. supporting the cover segments are preferably captured on their respective tracks so the cover segments will not be derailed or blown off by the wind or motion of the car when the car is travelling. Also not specifically shown, but contemplated herein, are latches to fix the cover segments in their open and closed positions. Sealing means may also be provided between overlapping or butted cover sections to more tightly enclose the cargo bed. Finally, the side sheets such as 172 shown in FIG. 3 may be extended above the top chords such as 98 and the wheel trucks to block the gaps beneath the outer edges 154 and 156 of the covers which provide clearance for the wheel trucks.

A different car 174 according to the present invention is illustrated in FIGS. 4–7. Identical reference characters in FIGS. 4–7 indicate parts corresponding to those of FIGS. 1–3.

Figure 4:
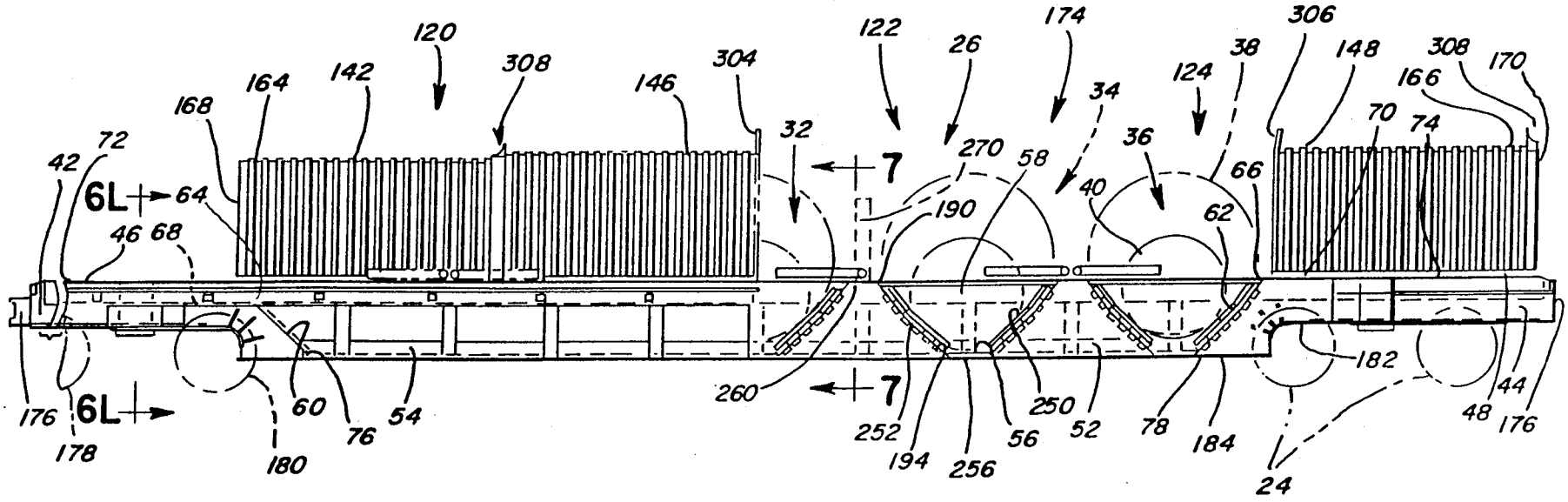
FIG. 4 is a view similar to FIG. 1 of another railroad car according to the present invention.

In addition to the features commonly numbered with FIG. 1, FIG. 4 further illustrates the construction of the area 176 which receives the coupler (not shown), the positioning of the wheels such as 178 and 180, the reinforcing gussets 181 in the bolster area 90, the turned lower web 182 of the draft sill which assists in directing draft and buff loads into the shear plate 184 and from there to the side sills 52 and 54, and other features.

Figure 6R:
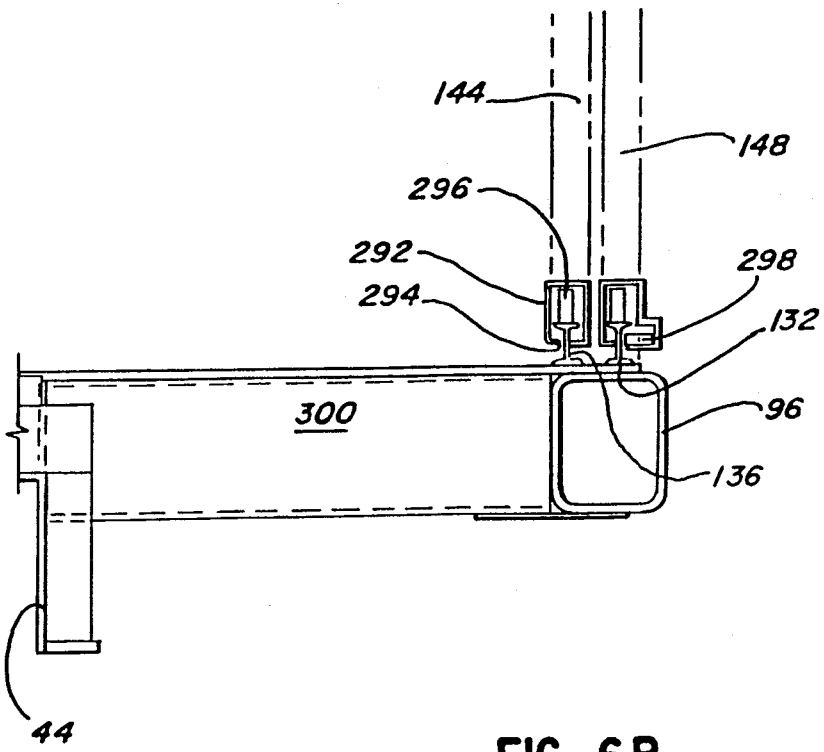
FIG. 6 is a composite view of FIG. 4, the left side being a half transverse section taken along line 6L—6L of FIG. 4, the right side being a half front elevation, with the upper walls of the telescoping cover shown in phantom.
Figure 6L:
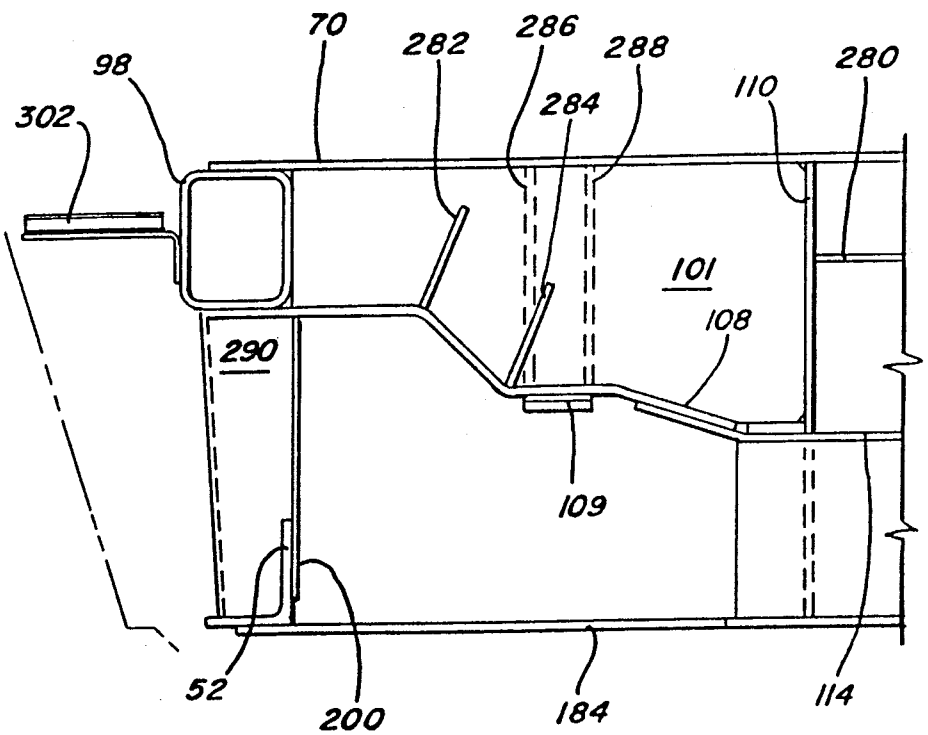

Apart from the coupler area 176 of the car 174, much of the construction from each end of the car 174 to the shear plates 184 is comparable to the construction of FIGS. 5 and 6 in the Gramse patent incorporated by reference above, or the structures shown in FIGS. 1–3.

One significant difference between Gramse et al. and the present invention is the provision of the walls 60 and 62 (best seen in FIG. 5) which bridge between the top web 70 of the draft sill (which is also an upper shear plate) and the lower shear plate 184. Another difference in the present invention is the elimination of the vertical bulkheads of FIGS. 5 and 6 of the Gramse structure. (The walls 60 and 62 distribute the vertical loads previously distributed by a vertical bulkhead.) Still another difference is that this car is adapted to have a coupler and a two-axle truck at each end, rather than the single axle trucks and articulation joints shown in the Gramse disclosure. Consequently, the bolster area 90 of the car incorporates a conventional center plate 186 which is received in the bolster bowl of a conventional wheel truck.

In FIGS. 4 and 5, more details of the wall 62 are provided. Each wall such as 62 comprises a plate 188, which in this embodiment is bent slightly in the middle along a transverse line. The plate 188 is welded to a bridge plate 189 having an upper end 190 secured to the end 192 of the upper shear plate 70 which is an extension of the top web of the draft sill. The plate 188 has a lower end 194 overlapping and welded to the lower shear plate 184. The sides of the plate 188 are folded up to form tabs 196 and 198. The side sheet 200 of the car 174 has boundaries 202, 204, 206, and 208 in the region of the wall 62. The tabs 196 and 198 are welded to the side sheet 200. The ends of the transverse reinforcement beams 210, 212, 214, 216, 218, and 220 are also welded directly to the side sheet 200 within the top chord 58. The troughs 28–36 thus reinforce the side sheets 200 and tie the draft sills 42 and 44, side sills 52 and 54, top chords such as 58, and shear plates such as 184 together. The side sheets such as 200 joined by the trough plates such as 60 and 62 can be compared to corrugated cardboard, which is much stronger than the webs from which it is made. Thus, the car does not require a separate floor sheet to tie the elements of the car together structurally.

To cushion the coil 38 when it is in the trough, the plate 188 is faced with wooden or other resilient slats 222, 224, 226, 228, 230 and 232 retained in place by cap bars 234 and 236. Wood or plastic slats 222–232 can readily be replaced as they become worn. A retaining bar 238 secured perpendicular to the tabs 196 and 198 at each side of the car further assists in keeping the wood slats in place.

The walls such as 250 and 252 of the interior troughs such as 34 are similar to the walls 60 and 62, and corresponding parts are numbered with the same reference characters. However, there are several specific differences. The ends 194 overlap and are welded to a transverse plate 256 which is secured at its respective ends to the side sills 52 and 54. The upper end 190 of the plate 189 is secured to an inverted U-shaped bridge 260 which extends transversely across the car and is located at a cut-out of the side sheet 200 so its sides may be directly welded to the inner webs of the top chords such as 58.

Figure 7:
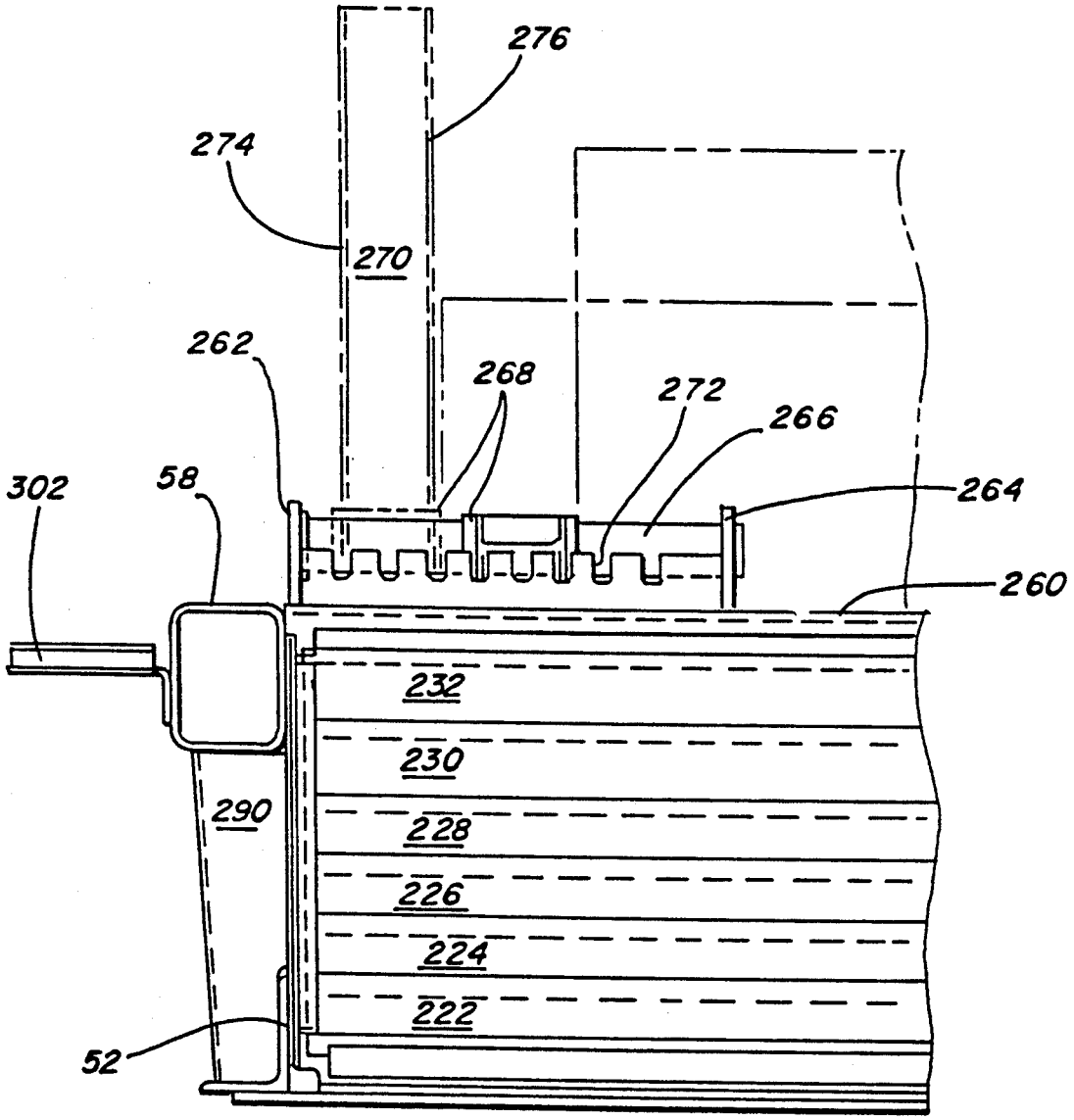
FIG. 7 is a half transverse section taken along line 7—7 of FIG. 4.

With reference to FIGS. 4 and 7, the brackets 262 and 264 mounted on the bridge 260 support transverse pins such as 266 which is fixed in place and carries a pivotable slide 268 to which a normally longitudinally disposed bar 270 is secured. The bracket 262 is a transverse, vertical plate which has a transverse row of recesses 272. A single pair of the recesses 272 can receive the webs 274 and 276 of the bar 270 when the bar 270 is pivoted about the pin 266 to the horizontal orientation shown in full lines in FIG. 4. When the recesses 272 engage the bar 270 it is restrained from transversely sliding. To slide the bar 270 in or out, it is pivoted about the pin 266 to the position shown in FIG. 7, the slide 268 is moved transversely on the pin 266, and the bar 270 is pivoted to a horizontal position to engage a different pair of recesses.

The purpose of the bars 270 is to prevent transverse sliding or telescoping of the steel coils carried in the troughs. The tendency of transverse coils or their inner turns to shift or telescope transversely is less than if they were oriented with their axes disposed longitudinally during transport. Thus, the bars 270 and associated hardware can be relatively light compared to the transverse coil separation bars of prior cars.

FIG. 6 shows several details of the car 174 which differ from the car 20 of FIGS. 1–3. In this embodiment, the functions of the top cover plate of the bolster area and the top web of the draft sill 42 are performed by the upper shear plate 68. The draft sill 42 has a separator web 280. Gussets 282 and 284 further stiffen the bolster area. The side bearing wear plate diaphragms 286 and 288 are shown in phantom, as they are out of the plane of the figure. The lower shear plate 184, side sill 52, side sheet 200, and side post 290 are also out of the plane of FIG. 6.

The side edges such as the edge 292 of the cover 144 are generally rectangular boxes in cross-section, each having a slot 294 to pass the track such as 136. The lips of the slot 294 capture the upper flange of the track 136 to keep the roller 296 substantially on the surface of the track 136. The cover 148 has a vertically pivoted guide roller 298 which follows the vertical web of the track 132 to capture and guide the cover 148. It will be appreciated that the track 136 and rollers 296 could be switched so the track was part of the cover 144 and the rollers 296 were pivotally mounted to the top chords 96 and 98.

FIG. 6 also illustrates an end sill 300 and a running board 302.

FIG. 4 also illustrates two expedients to prevent snow and ice accumulating on the cover segments from falling on the rolls or interfering with the movement of the cover segments. The meeting center covers 146 and 148 can have upstanding lips 304 and 306 which abut when the cover is closed. The lips will prevent snow from dropping between the cover segments onto the cargo bed when the cover segments 146 and 148 are separated. Also, the plows 308 disposed along the overlapping top and sides of the cover 146 will shear under interfering ice and snow on the top and sides of the cover 142 when the covers are telescoped. This expedient will reduce the amount of force needed to telescope the covers under icy and snowy conditions.

Figure 8:
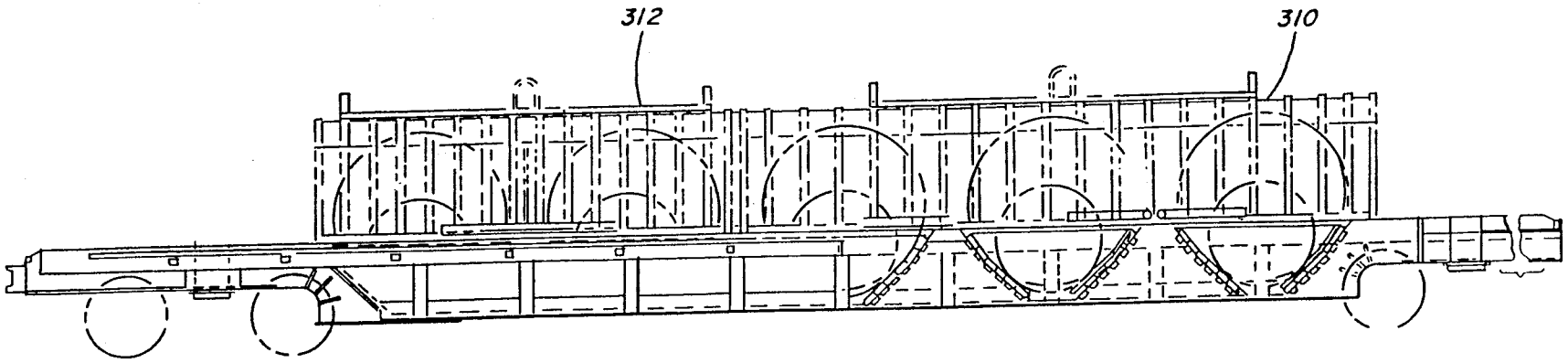
FIG. 8 is a view similar to FIG. 1 of a car which has a two piece lift-off cover.
Figure 9:
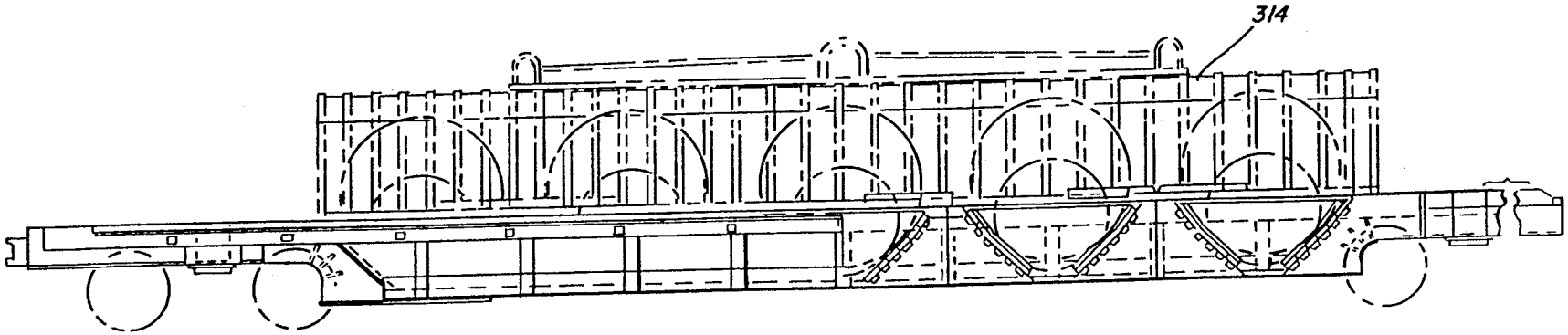
FIG. 9 is a view similar to FIG. 1 of a car which has a one piece lift-off cover.

FIGS. 8 and 9 show removable covers which may alternatively be used to enclose the coils. FIG. 8 shows a two-piece cover having a larger segment 310 and a smaller segment 312. The segments are unequal so their interface will be between two cylindrical objects, rather than over one of them. Thus, any single object can be unloaded vertically after only one cover is removed. FIG. 9 shows a one-piece cover 314.

The covers 310–314, like the previously-described telescoping covers, are not as tall as the diameter of the largest object which the troughs are intended to receive. The rise of the cover above the previously-defined first horizontal plane is also less than the diameter of the largest object to be carried with the covers closed. This greatly reduces the weight of the cover and the amount of air (and thus atmospheric water vapor) enclosed with the cylindrical objects when the cover is closed. This also lowers the height of the covered car.

We claim:

1. A railroad car for transporting at least one cylindrical object with its axis horizontal and transverse to the direction of travel of the car, said car comprising:

A. at least front and rear wheel trucks;

B. a body comprising a front stub draft sill supported on said front wheel truck, a rear stub draft sill supported on said rear wheel truck, said stub draft sills having upper extremities defining a first horizontal plane, a cargo bed between said stub draft sills, and at least one lower longitudinal member running beneath the center of said cargo bed and below the level of said stub draft sills, said lower longitudinal member being disposed in a second horizontal plane below said first horizontal plane and being adapted for accepting a portion of the longitudinal draft and buff loads between said front stub draft sill and said rear stub draft sill;

C. at least one pair of generally planar, longitudinally spaced, facing front and rear cylindrical object support members, each inclined about a horizontal and transverse axis toward the other, each said pair defining a trough for receiving and supporting a cylindrical object with its axis horizontally and transversely oriented, said trough being adapted to support a cylindrical object so that at least a portion of the object projects below said first horizontal plane when loaded, thereby lowering the center of gravity of said car when loaded; and D. a pair of top chords which extend along either side of the cargo bed at an elevation above the bottom of the cylindrical object and which transmit part of the longitudinal draft and buff loads through the car.

2. The railroad car of claim 1 wherein each of said front and rear cylindrical object support members has an upper edge spanning said cargo bed and secured between said top chords and a lower edge secured to the lower longitudinal member.

3. The railroad car of claim 1, further comprising:

A. a pair of top chords extending longitudinally between said draft sills and outside said cargo bed; and B. at least one cover for protecting the cylindrical objects, said cover having side edges received by said top chords and an upper wall bridging between said side edges, wherein the rise of said upper wall above said first horizontal plane when said cover is in place is less than the diameter of the largest object which said car is adapted to carry.

4. The railroad car of claim 3, wherein said cargo bed has front, center, and rear portions and said cover is a telescoping cover assembly comprising:

A. left and right longitudinal track means running along said upper side sills and having outboard extremities;

B. a front cover segment carried on said track means, said front cover segment being adapted to bridge the cargo bed between the track means and to be movable along the track means between an inboard position for covering the front portion of the cargo area and an outboard position for exposing the front portion of the cargo area;

C. a rear cover segment carried on said track means, said rear cover segment being adapted to bridge the cargo bed between the track means and to be movable along the track means between an inboard position for covering the rear portion of the cargo bed and an outboard position for exposing the rear portion of the cargo bed; and D. at least a first center cover segment carried on said track means, said center cover segment being adapted to bridge the cargo bed between the track means and to be movable on the track means between an inboard position for covering the center portion of the cargo bed and an outboard position telescoped with one of said front and rear cover segments;

E. whereby said cover assembly is adapted to expose substantially the entire cargo bed at once when said cover segments are all in their outboard positions and to cover substantially the entire cargo bed at once when said cover segments are all in their inboard positions.

5. A railroad car for transporting at least one cylindrical object with its axis horizontal and transverse to the direction of travel of the car, said car comprising:

A. at least front and rear wheel trucks;

B. a body comprising a front stub draft sill supported on said front wheel truck, a rear stub draft sill supported on said rear wheel truck, said stub draft sills having upper extremities defining a first horizontal plane, at least one lower longitudinal member running beneath the center of said cargo bed and below the level of said stub draft sills, said lower longitudinal member being disposed in a second horizontal plane below said first horizontal plane for accepting at least a portion of the longitudinal loads between said front stub draft sill and said rear stub draft sill, and a cargo bed between said draft sills; and C. at least one pair of generally planar, longitudinally spaced, facing front and rear cylindrical object support members, each inclined about a horizontal and transverse axis toward the other, each said pair defining a trough for receiving and supporting a cylindrical object with its axis horizontally and transversely oriented, said trough being adapted to support a cylindrical object so that at least a portion of the object projects below said first horizontal plane when loaded, thereby lowering the center of gravity of said car when loaded, D. wherein a first said front cylindrical object support member is adjacent to said front stub draft sill, a last said rear cylindrical object support member is adjacent to said rear stub draft sill, and E. wherein each of said first and last cylindrical object support members has an outboard upper edge secured to the adjacent stub draft sill and an inboard lower edge secured to said lower longitudinal member to transmit and receive longitudinal loads obliquely between said draft sills and said lower longitudinal member.

6. A telescoping cover assembly for a railroad car having left and right transversely spaced edges, front and rear ends, and a cargo bed disposed between the ends and between the edges, the cargo bed comprising a front end portion and a rear end portion, said cover assembly comprising:

A. left and right longitudinal track means running parallel to the edges of the car;

B. a front cover segment carried on said track means, said front cover segment being adapted to bridge the cargo bed between the track means and to be movable between an inboard position for covering the front end portion of the cargo bed and an outboard position for exposing the front end portion of the cargo bed; and C. a rear cover segment carried on said track means and adapted to bridge the cargo bed between the track means and to be movable between an inboard position for covering the rear end portion of the cargo bed and an outboard position for exposing the rear end portion of the cargo bed;

whereby said cover assembly is adapted to expose substantially the entire cargo bed at once when said front and rear cover segments are in their outboard positions and to cover substantially the entire cargo bed at once when said front and rear cover segments are in their inboard positions.

7. The cover assembly of claim 6 for a railroad car including a center portion of said cargo bed between the front and rear portions, said cover assembly further comprising at least a first center cover segment carried on said track means, said center cover segment being adapted to bridge the cargo bed between the track means and to be movable between an inboard position for covering at least a part of the center portion of the cargo bed and an outboard position telescoped with one of said front and rear cover segments.

8. The cover assembly of claim 7, further comprising a second center cover segment carried on said track means between said first center cover segment and one of said front and rear cover segments, said second center cover segment being adapted to bridge the cargo bed between the track means and to be movable between an inboard position for covering at least part of the center portion of the cargo bed and an outboard position telescoped with one of said front and rear cover segments.

9. The cover assembly of claim 8, wherein said first center cover segment is adapted to telescope with said front cover segment when in its outboard position and said second center cover segment is adapted to telescope with said rear cover segment when in its outboard position.

10. The cover assembly of claim 8, wherein said first and second center cover segments run on a pair of common track means and said front and rear cover segments run on separate, collinear pairs of track means.

11. The cover assembly of claim 7, wherein said center cover segment has an upper wall bridging between said left and right track means and having front and rear edges defining front and rear openings, whereby said center cover segments are adapted to clear cargo carried on the cargo bed.

12. The cover assembly of claim 6, wherein said track means have outboard extremities which extend longitudinally outboard of said cargo bed.

13. The cover assembly of claim 6, wherein said track means have outboard extremities and are fixed to said car and said front and rear cover segments have left and right sides disposed adjacent to the respective track means, said sides each having an inboard end, an outboard end, and wheel trucks spaced inboard of said outboard ends to engage said track means, whereby the portions of said front and rear cover segments outboard of said wheel trucks are cantilevered beyond the outboard ends of said track means when said front and rear cover segments are in their outboard positions.

14. The cover assembly of claim 6, wherein said cover segments overlap when in their inboard positions to define a substantially continuous cover.

15. A telescoping cover assembly for a railroad car having left and right horizontally and transversely spaced edges, front and rear ends, and a cargo bed disposed between the ends and between the edges, the cargo bed comprising a front portion and a rear portion, said cover assembly comprising:

A. left and right longitudinal track means running parallel to the edges of the car;

B. a front cover segment carried on said track means, said front cover segment being adapted to bridge the cargo bed between the track means and to be movable between an inboard position for covering the front portion of the cargo bed and an outboard position for exposing the front portion of the cargo bed; and C. a rear cover segment carried on said track means and adapted to bridge the cargo bed between the track means and to be movable between an inboard position for covering the rear portion of the cargo bed and an outboard position for exposing the rear portion of the cargo bed;

wherein each of said front and rear cover segments has an upper wall bridging between said left and right track means and having inboard and outboard edges and an outer wall substantially closing the area bounded by each said outboard edge;

whereby said cover assembly is adapted to expose substantially the entire cargo bed at once when said front and rear cover segments are in their outboard positions and to cover substantially the entire cargo bed at once when said front and rear cover segments are in their inboard positions.

16. A telescoping cover assembly for a railroad car having left and right transversely spaced edges, front and rear ends, and a cargo bed disposed between the ends and between the edges, the cargo bed comprising a front portion, a rear portion, and a center portion, said cover assembly comprising:

A. left and right longitudinal track means running parallel to the edges of the car;

B. a front cover segment carried on said track means, said front cover segment being adapted to bridge the cargo bed between the track means and to be movable between an inboard position for covering the front portion of the cargo bed and an outboard position forward of said inboard position for exposing the front portion of the cargo bed; and C. a rear cover segment carried on said track means and adapted to bridge the cargo bed between the track means and to be movable between an inboard position for covering the rear portion of the cargo bed and an outboard position behind the inboard position of said rear cover segment for exposing the rear portion of the cargo bed;

whereby said cover assembly is adapted to expose substantially the entire cargo bed at once when said cover segments are in their outboard positions and to cover substantially the entire cargo bed at once when said cover segments are in their inboard positions.

17. The cover assembly of claim 16, further comprising at least a first center cover segment carried on said track means, said center cover segment being adapted to bridge the cargo bed between the track means and to be movable between an inboard position for covering at least a part of the center portion of the cargo bed and an outboard position telescoped with one of said front and rear cover segments.

18. The cover assembly of claim 17, wherein said center cover segment has an upper wall bridging between said left and right track means and having front and rear edges defining front and rear openings, whereby said center cover segments are adapted to clear cargo carried on the cargo bed.

19. The cover assembly of claim 16, wherein said track means have outboard extremities which extend longitudinally outboard of said cargo bed.

20. The cover assembly of claim 16, wherein said cover segments overlap when in their inboard positions to define a substantially continuous cover.

* * * * *